US009331410B2

(12) United States Patent
Obikane et al.

(10) Patent No.: US 9,331,410 B2
(45) Date of Patent: May 3, 2016

(54) ELECTRICAL CONNECTOR

(71) Applicants: Japan Aviation Electronics Industry, Limited, Tokyo (JP); JAE Electronics, Inc., Irvine, CA (US)

(72) Inventors: Hiroaki Obikane, Tokyo (JP); Takayuki Nishimura, Tokyo (JP); Toshiro Kobuchi, Tokyo (JP); Daisuke Machihara, Irvine, CA (US)

(73) Assignees: Japan Aviation Electronics Industry, Limited, Tokyo (JP); JAE Electronics, Inc., Irvine, CA (US)

( * ) Notice: Subject to any disclaimer, the term of this patent is extended or adjusted under 35 U.S.C. 154(b) by 77 days.

(21) Appl. No.: 13/956,800

(22) Filed: Aug. 1, 2013

(65) Prior Publication Data

US 2014/0256195 A1 Sep. 11, 2014

Related U.S. Application Data

(60) Provisional application No. 61/772,610, filed on Mar. 5, 2013.

(51) Int. Cl.

| | |
|---|---|
| ***H01R 13/02*** | (2006.01) |
| ***H01R 12/70*** | (2011.01) |
| *H01R 12/50* | (2011.01) |
| *H01R 12/71* | (2011.01) |
| *H01R 12/73* | (2011.01) |

(52) U.S. Cl.

CPC ..... *H01R 13/02* (2013.01); *H01R 12/7088* (2013.01); *H01R 12/716* (2013.01); *H01R 12/73* (2013.01); *H01R 23/7073* (2013.01); *H01R 23/725* (2013.01)

(58) Field of Classification Search

CPC ..... H01R 23/7073; H01R 23/725

USPC ..... 439/74, 660

See application file for complete search history.

(56) References Cited

U.S. PATENT DOCUMENTS

| | | | | |
|---|---|---|---|---|
| 7,699,619 | B2 | 4/2010 | Mizumura | |
| 8,845,339 | B2 * | 9/2014 | Ono | 439/74 |
| 2010/0221928 | A1 | 9/2010 | Sato et al. | |
| 2013/0012039 | A1 * | 1/2013 | Nose | H01R 12/716 439/74 |
| 2013/0012074 | A1 * | 1/2013 | Mashiyama | H01R 12/73 439/660 |

FOREIGN PATENT DOCUMENTS

| | | | |
|---|---|---|---|
| JP | H09-237655 | A | 9/1997 |
| JP | 3195293 | B2 | 8/2001 |
| JP | 2010-182608 | A | 8/2010 |
| JP | 2010-198996 | A | 9/2010 |
| JP | 2013-016410 | A | 1/2013 |

OTHER PUBLICATIONS

Korean Office Action dated Jul. 18, 2014 in KR 10-2013-0106512 with English translation of relevant parts.

* cited by examiner

*Primary Examiner* — Abdullah Riyami
*Assistant Examiner* — Justin Kratt
(74) *Attorney, Agent, or Firm* — Collard & Roe, P.C.

(57) ABSTRACT

A plug connector 1 includes a plug-side housing 5 and plug-side power supply contact 5A which is held by the plug-side housing 5 and in which a power supply current flows, the plug-side power supply contact 5A comprises at least a pair of integrally formed spring contact portions 15A and 15B each having a bent-plate shape, and the pair of contact portions 15A and 15B are provided so that their flat surfaces face each other.

7 Claims, 17 Drawing Sheets

ELECTRICAL CONNECTOR

This application claims priority to, and the benefit of, U.S. Provisional Patent Application No. 61/772,610, filed Mar. 5, 2013, which is hereby incorporated by reference in its entirety.

BACKGROUND OF THE INVENTION

This invention relates to an electrical connector.

As an electrical connector for connecting surfaces of boards to each other, a board connector (board-to-board connector) has conventionally been used.

The board connector is in the form of a pair of a plug connector and a receptacle connector. The plug connector is inserted into the receptacle connector so that contact members of the connectors are brought into contact with each other, thereby establishing electrical connection therebetween.

The plug connector and the receptacle connector each comprise an insulating housing and conductive signal contacts held by the housing.

Herein, when an electrical connector is used as a power supply connector, power supply contacts may be provided in addition to signal contacts.

As the electrical connector having the power supply contacts, there is known, as described in, for example, Japanese Patent Application Publication No. 2013-16410 (JP-A-2013-16410), a structure in which a plug connector and a receptacle connector each have connecting portions (mounting portions) for mounting to a board and a contact portion (contact point portion) for contact with a power supply contact of the mating connector and, by bringing the contact portions into contact with each other, the power supply contacts are electrically connected together.

On the other hand, in the above-mentioned structure, since there is the single contact portion, a power supply current is concentrated on this contact portion. Therefore, in order to prevent heat generation due to electrical conduction, a structure with a large current capacity, specifically, an increase in size of the contact, is required.

However, in recent years, board connectors have been widely applied to small terminals such as mobile telephones and thus miniaturization is required also for electrical connectors so that it is difficult to increase the size of power supply contacts.

In view of this, there is known, as described in Japanese Patent Application Publication No. 2010-198996 (JP-A-2010-198996), a structure in which three contact portions are provided to divide a power supply current.

Specifically, as shown in FIG. 7, a first fixture 54 as a power supply terminal in JP-A-2010-198996 has one elastic piece 80 and two protruding projections 781 and thus has a total of three contact portions as portions for contact with a mating power supply contact.

SUMMARY OF THE INVENTION

However, since the structure of JP-A-2010-198996 is such that, of the three contact portions, the two contact portions (projections 781) are smaller than the other contact portion (elastic piece 80), resulting in an uneven shape, there has been a problem that, after all, the power supply current is concentrated on this other contact portion and thus is not sufficiently divided.

This invention has been made for the purpose of improving such problems and it is an object of this invention to provide an electrical connector that can surely divide a power supply current and thus can prevent heat generation due to electrical conduction.

In order to achieve the above-mentioned object, according to the first aspect of the present invention, there is provided an electrical connector comprising; a housing; and a power supply contact which is held by the housing and in which a power supply current flows, wherein the power supply contact comprises at least a pair of integrally formed spring contact portions each having a bent-plate shape, and wherein the pair of contact portions are provided so that their flat surfaces face each other.

In the first aspect, the power supply contact may comprise a mounting portion which is provided so as to be offset with respect to the flat surfaces of the contact portions.

Further, in the first aspect, the power supply contact may comprise a connecting portion which connects the pair of contact portions to each other.

Still further, in the first aspect, the pair of contact portions may be symmetrical in shape with each other.

On the other hand, in the first aspect, the electrical connector may be a plug connector, and the connecting portion may have a plate-like shape and be provided so as to connect inner end portions of the contact portions to each other.

Alternatively, in the first aspect, the electrical connector may be a receptacle connector, and the connecting portion may have a plate-like shape and be provided so as to connect outer end portions of the contact portions to each other.

Further, in the first aspect, the connecting portion may be provided with a mounting portion.

Still further, in the first aspect, the electrical connector may comprise a plurality of signal contacts which are held by the housing and in which a signal current flows. In this case, the power supply contact is provided at each of both ends in an arrangement direction of the signal contacts.

According to the second aspect of the present invention, there is provided a connector unit comprising, in combination, the electrical connector according to the first aspect and a mating connector.

According to the third aspect of the present invention, there is provided an electrical connector comprising: a housing; and a power supply contact which is held by the housing and in which a power supply current flows, wherein the power supply contact comprises at least a pair of integrally formed contact portions each in the form of a plate-like member having a U-shape as seen in a surface direction, and wherein the pair of contact portions are provided so that their flat surfaces face each other.

In the third aspect, the power supply contact may comprise a mounting portion which is provided so as to be offset with respect to the flat surfaces of the contact portions.

Further, in the third aspect, the power supply contact may comprise a connecting portion which connects the pair of contact portions to each other.

Still further, in the third aspect, the pair of contact portions may be symmetrical in shape with each other.

On the other hand, in the third aspect, the electrical connector may be a plug connector and the connecting portion may have a plate-like shape and may be provided so as to connect inner end portions of the contact portions to each other.

Alternatively, in the third aspect, the electrical connector may be a receptacle connector and the connecting portion may have a plate-like shape and may be provided so as to connect outer end portions of the contact portions to each other.

Further, in the third aspect, the connecting portion may be provided with a mounting portion.

Still further, in the third aspect, the electrical connector may comprise a plurality of signal contacts which are held by the housing and in which a signal current flows. In this case, the power supply contact is provided at each of both ends in an arrangement direction of the signal contacts.

According to this invention, it is possible to provide an electrical connector that can surely divide a power supply current and thus can prevent heat generation due to electrical conduction.

DETAILED DESCRIPTION OF THE INVENTION

Hereinbelow, an embodiment of this invention will be described in detail with reference to the drawings.

First, referring to FIGS. 1 to 6C, a connector unit 100 and connectors forming the connector unit 100 according to this embodiment will be briefly described.

Herein, a board connector is exemplarily shown as the connector unit 100.

Figure 1:
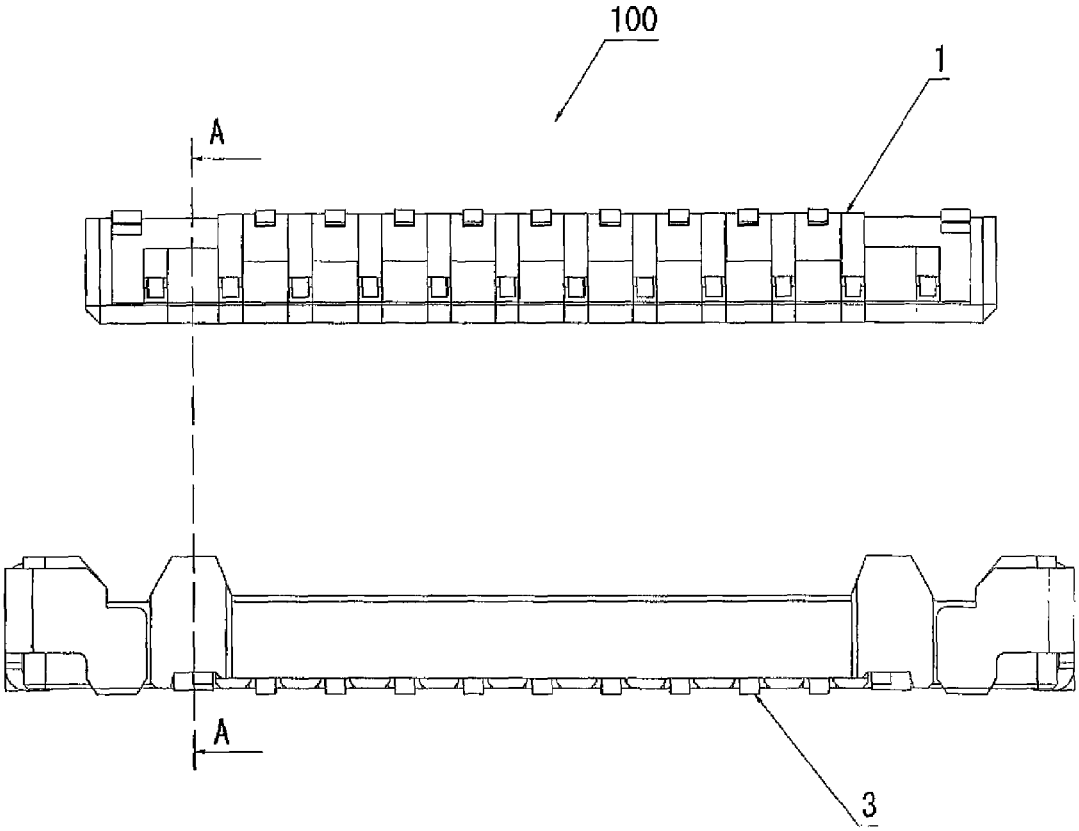
FIG. 1 is a side view showing a connector unit.

As shown in FIG. 1, the connector unit 100 comprises a plug connector 1 and a receptacle connector 3.

The connector unit 100 is a board connector for connecting together, for example, a flexible printed circuit (FPC) and a rigid board which are not illustrated. In this case, for example, the plug connector 1 is provided on the flexible printed circuit while the receptacle connector 3 as a mating connector is provided on the rigid board.

Figure 2A:
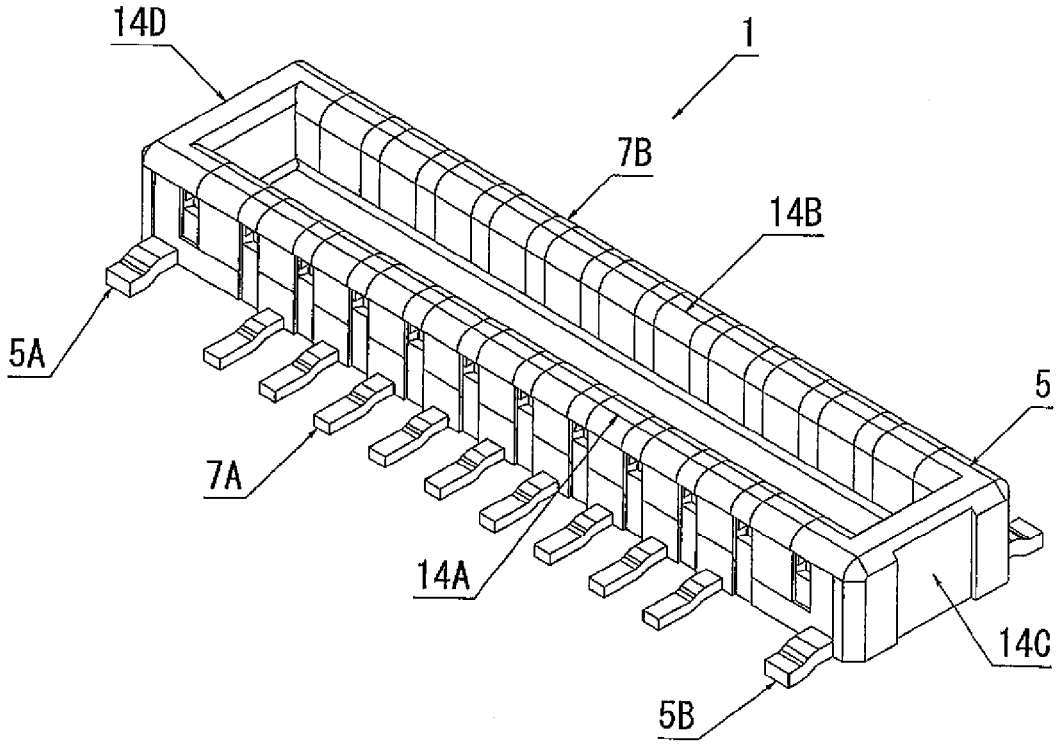
FIG. 2A is a perspective view showing a plug connector of FIG. 1.
Figure 2B:
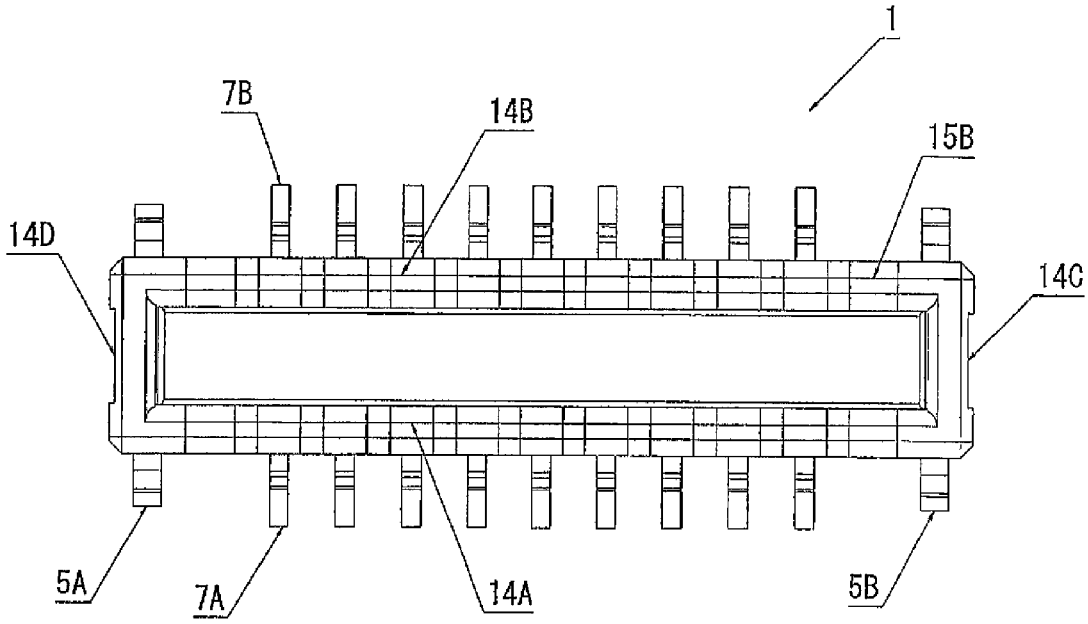
FIG. 2B is a plan view showing the plug connector of FIG. 1.
Figure 2C:
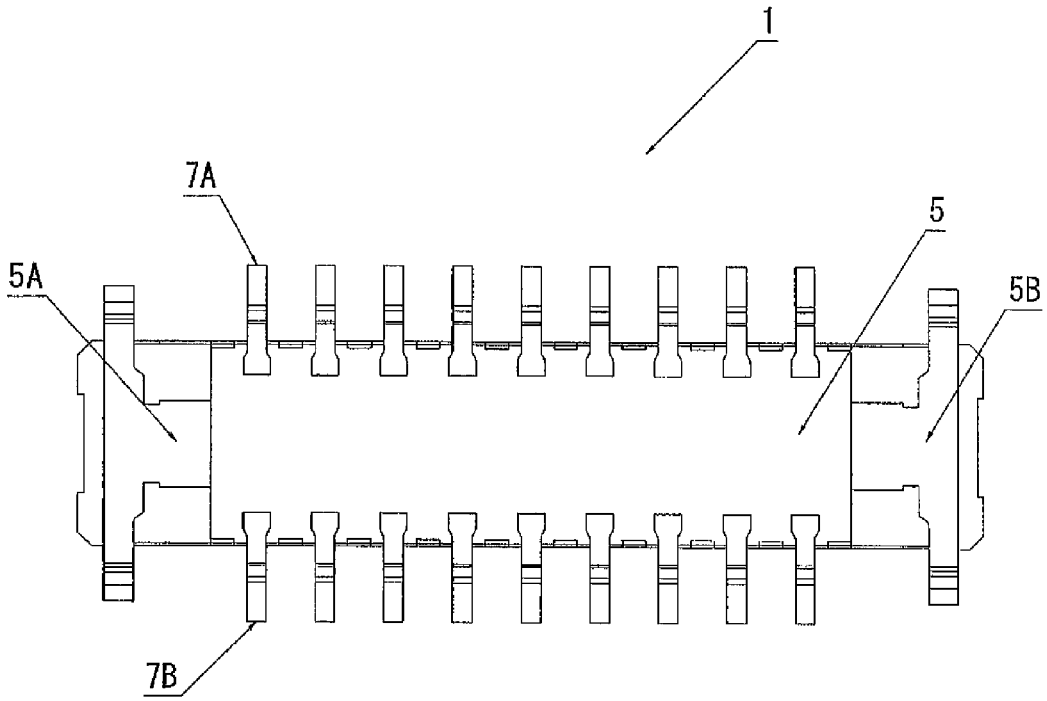
FIG. 2C is a bottom view showing the plug connector of FIG. 1.

As shown in FIGS. 2A to 2C, the plug connector 1 comprises a plug-side housing 5 which is a housing having a rectangular shape in plan view, plug-side signal contacts 7A and 7B which are arranged at a predetermined pitch in a longitudinal direction of the plug-side housing 5 and in which a signal current flows, and plug-side power supply contacts 5A and 5B which are respectively provided at both ends in an arrangement direction of the plug-side signal contacts 7A and 7B (herein, at both ends in the longitudinal direction of the plug-side housing 5) and in which a power supply current flows.

Figure 4A:
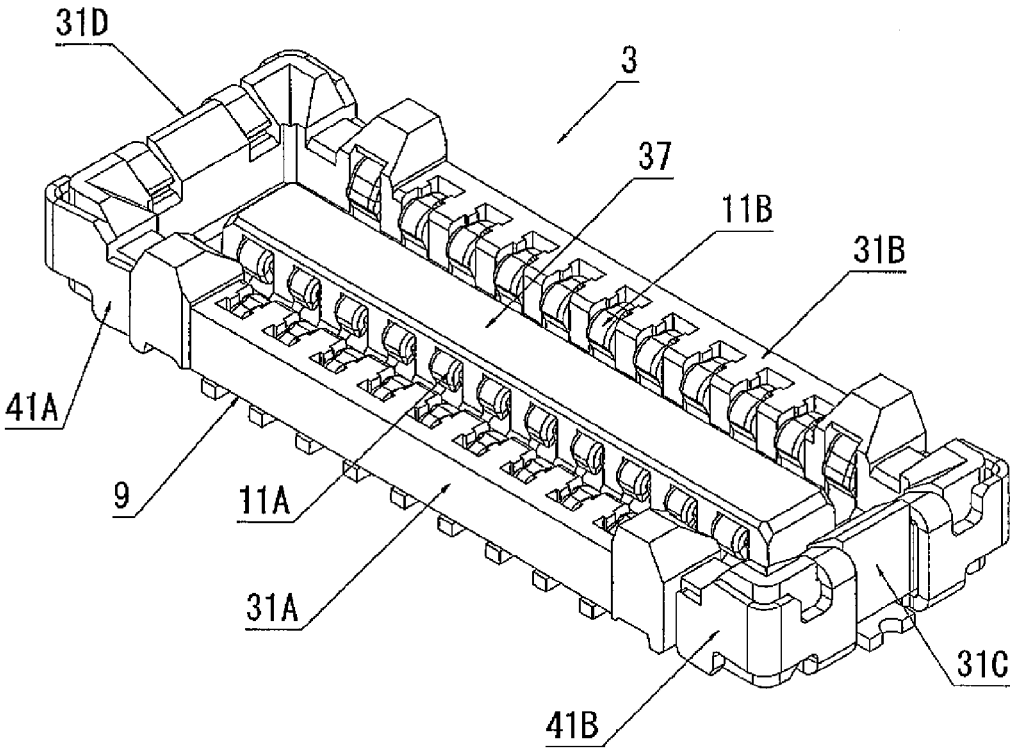
FIG. 4A is a perspective view showing a receptacle connector of FIG. 1.
Figure 4B:
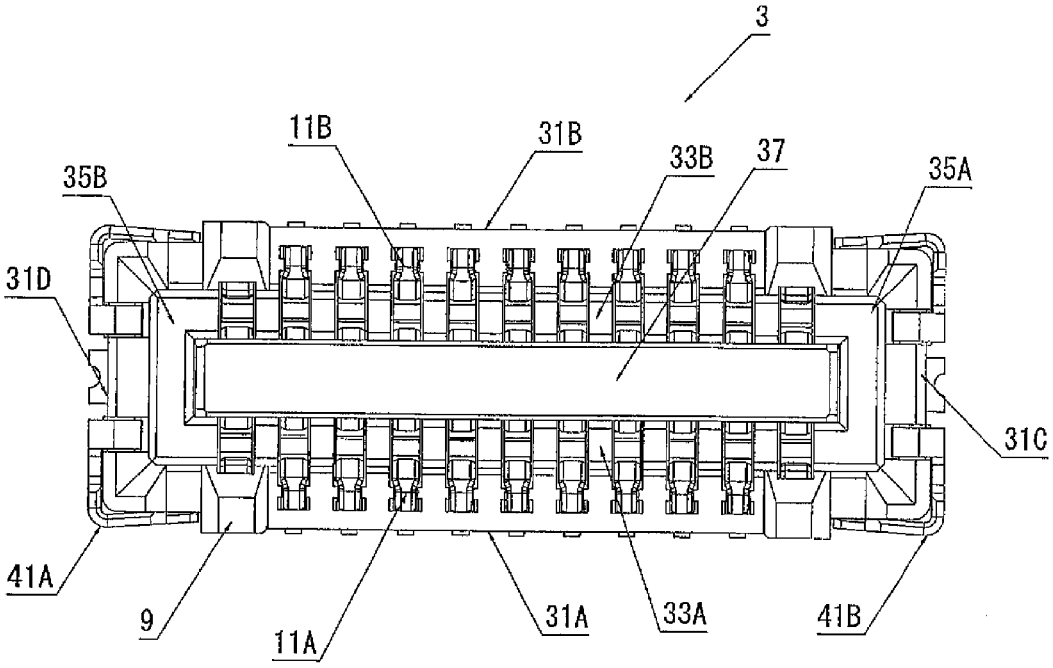
FIG. 4B is a plan view showing the receptacle connector of FIG. 1.
Figure 4C:
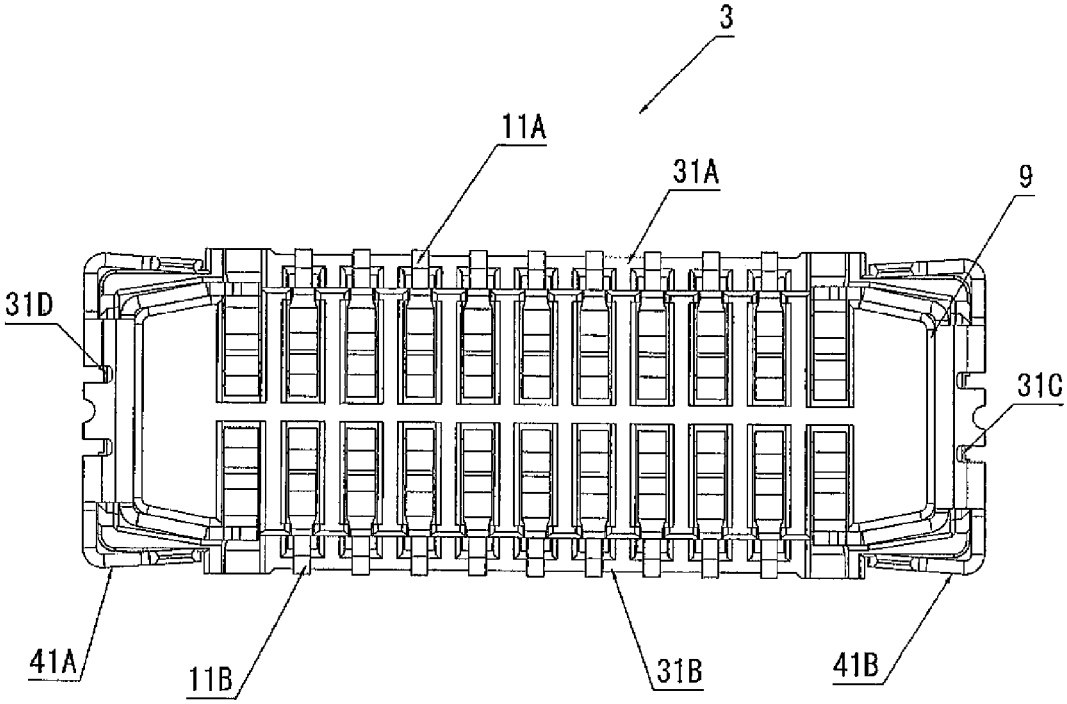
FIG. 4C is a bottom view showing the receptacle connector of FIG. 1.

As shown in FIGS. 4A to 4C, the receptacle connector 3 comprises a thick plate-like receptacle-side housing 9 having a rectangular shape in plan view, receptacle-side signal contacts 11A and 11B (i.e. contacts where a signal current flows) which are arranged at a predetermined pitch in a longitudinal direction of the receptacle-side housing 9 and adapted to be connected to the plug-side signal contacts 7A and 7B, and receptacle-side power supply contacts 41A and 41B (i.e. contacts where a power supply current flows) which are respectively provided at both ends in an arrangement direction of the receptacle-side signal contacts 11A and 11B (herein, at both ends in the longitudinal direction of the receptacle-side housing 9) and adapted to be connected to the plug-side power supply contacts 5A and 5B.

Next, the structure of the plug-side housing 5 will be described in more detail with reference to FIGS. 2A to 3B.

As shown in FIGS. 2A to 2C, the plug-side housing 5 of the plug connector 1 comprises a pair of elongated plate-like mating-side fitting portions 14A and 14B arranged parallel to each other and connecting portions 14C and 14D respectively connecting between end portions of the mating-side fitting portions 14A and 14B. The mating-side fitting portions 14A and 14B and the connecting portions 14C and 14D form a frame shape in plan view.

The plug-side signal contacts 7A and 7B are provided at the mating-side fitting portions 14A and 14B, respectively.

Figure 3A:
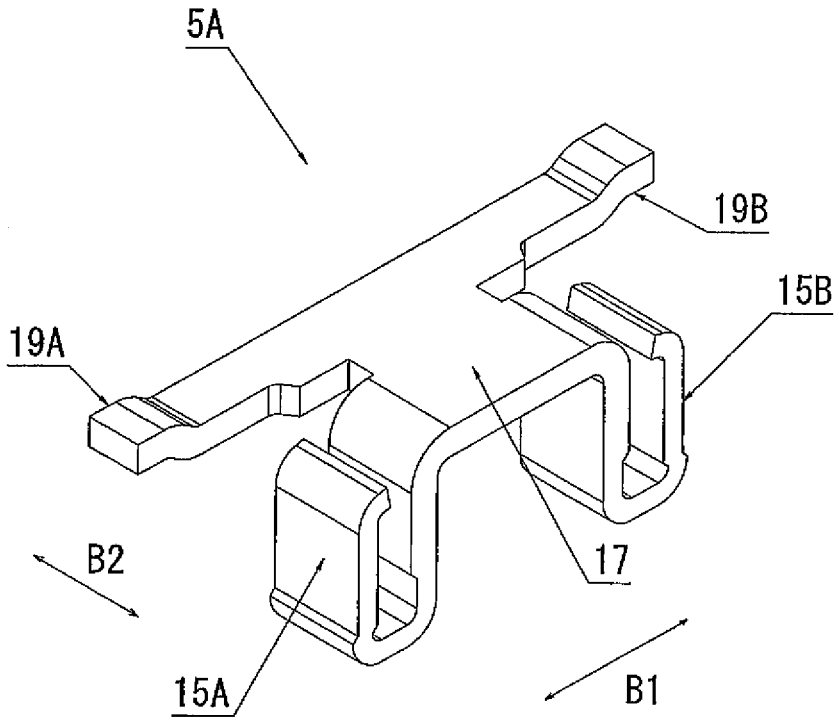
FIG. 3A is a perspective view showing a plug-side power supply contact.
Figure 3B:
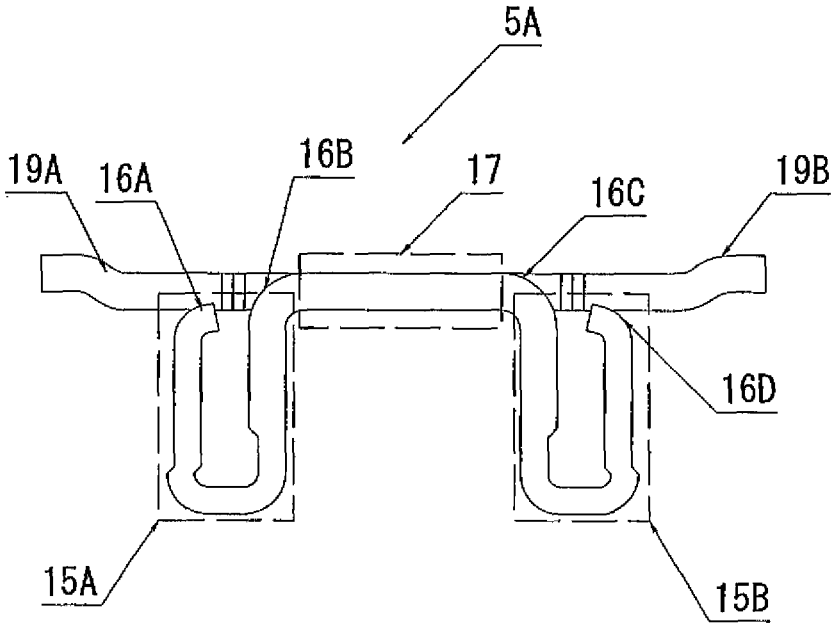
FIG. 3B is a front view showing the plug-side power supply contact.

As shown in FIGS. 3A and 3B, the plug-side power supply contact 5A comprises a pair of integrally formed spring contact portions 15A and 15B each having a bent-plate shape. The pair of contact portions 15A and 15B are provided so that their flat surfaces face each other.

Herein, the contact portions 15A and 15B each have a U-shape as a front shape (the shape in an end face direction of the flat surface, herein, the shape in a direction of FIG. 3B).

The contact portions 15A and 15B are symmetrical in shape with each other as seen from the front (FIG. 3B).

Further, the contact portions 15A and 15B are integrally formed through a plate-like connecting portion 17. Herein, the connecting portion 17 is provided so as to connect, among end portions 16A, 16B, 16C, and 16D of the contact portions 15A and 15B, the end portions 16B and 16C being the inner end portions to each other.

Although details will be described later, by configuring the plug-side power supply contact 5A to have the pair of integrally formed spring contact portions 15A and 15B, it is possible to surely divide a current path into the contact portions 15A and 15B in electrical conduction and thus to prevent heat generation due to the electrical conduction.

In particular, by arranging the contact portions 15A and 15B to be symmetrical in shape, the power supply current can be surely divided when it flows.

Further, by forming each of the contact portions 15A and 15B as the U-shaped bent-plate spring, the spring length can be set long and thus, even if the plug connector 1 and the receptacle connector 3 are repeatedly attached and detached, it is possible to prevent the contact portions 15A and 15B from being deformed due to metal fatigue.

On the other hand, the plug-side power supply contact 5A has mounting portions 19A and 19B for connecting the plug connector 1 to a board or the like as a connection object. Herein, the mounting portions 19A and 19B are surface mount (SMT) terminals for connection to the board or the like by soldering.

As shown in FIGS. 3A and 3B, the mounting portions 19A and 19B are provided so as to be offset with respect to the facing surfaces of the contact portions 15A and 15B.

More specifically, the mounting portions 19A and 19B are arranged so as to be offset in a direction (direction B2 in FIG. 3A) crossing a direction (direction B1 in FIG. 3A) in which the surfaces of the contact portions 15A and 15B face each other.

In this manner, by offsetting the arrangement of the mounting portions 19A and 19B, i.e. by arranging the mounting portions 19A and 19B in a position so as not to overlap the contact portions 15A and 15B in the plane, even if solder wicking occurs when the mounting portions 19A and 19B are soldered to the non-illustrated board or the like, the solder does not reach the contact portions 15A and 15B.

Consequently, it is possible to prevent an increase in contact resistance of the contact portions 15A and 15B due to adhesion of the solder thereto and to prevent heat generation due to such an increase in contact resistance.

Since the structure of the plug-side power supply contact 5B is the same as that of the plug-side power supply contact 5A, description thereof is omitted.

Next, the structure of the receptacle connector 3 will be described in more detail with reference to FIGS. 4A to 5D.

As shown in FIGS. 4A to 4C, the receptacle-side housing 9 of the receptacle connector 3 comprises a pair of first side wall portions 31A and 31B having a longitudinal direction in a pitch direction of the receptacle-side signal contacts 11A and 11B and facing each other and a pair of second side wall portions 31C and 31D facing each other and respectively connecting between end portions of the pair of first side wall portions 31A and 31B. Herein, the first side wall portions 31A and 31B are portions corresponding to long sides of the rectangular shape while the second side wall portions 31C and 31D are portions corresponding to short sides of the rectangular shape.

As shown in FIG. 4B, on an upper surface of the receptacle-side housing 9, groove portions 33A and 33B into which the mating-side fitting portions 14A and 14B of the plug connector 1 are inserted are formed along the long sides of the rectangular shape, and the receptacle-side signal contacts 11A and 11B are arranged at a predetermined pitch in the longitudinal direction and lie over the groove portions 33A and 33B.

End portions of the groove portions 33A and 33B are connected together by connecting grooves 35A and 35B formed along the short sides of the rectangular shape so that the plan-view shape as a whole corresponds to the frame shape of the plug-side housing 5 of the plug connector 1. A convex portion 37 of a convex shape is formed at a middle portion.

As shown in FIGS. 5A to 5D, the receptacle-side power supply contact 41A comprises a pair of integrally formed spring contact portions 21A and 21B each having a bent-plate shape. The pair of contact portions 21A and 21B are provided so that their flat surfaces face each other.

Herein, the contact portions 21A and 21B each have a U-shape as a front shape (the shape in a surface direction of the flat surface), which is a shape engageable with the contact portion 15A or 15B.

Specifically, the shapes are such that the outside of the U-shape of the contact portion 15A, 15B and the inside of the U-shape of the contact portion 21A, 21B are engageable with each other when they are brought into contact with each other.

Figure 5A:
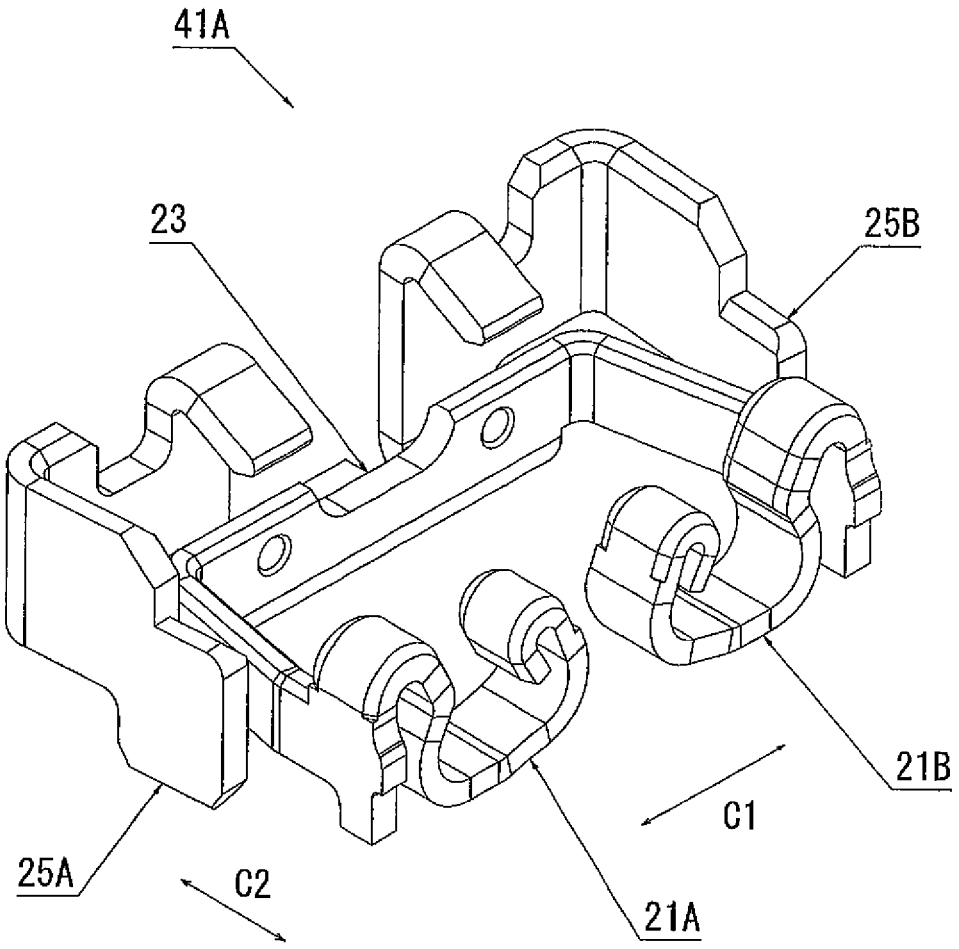
FIG. 5A is a perspective view showing a receptacle-side power supply contact.
Figure 5B:
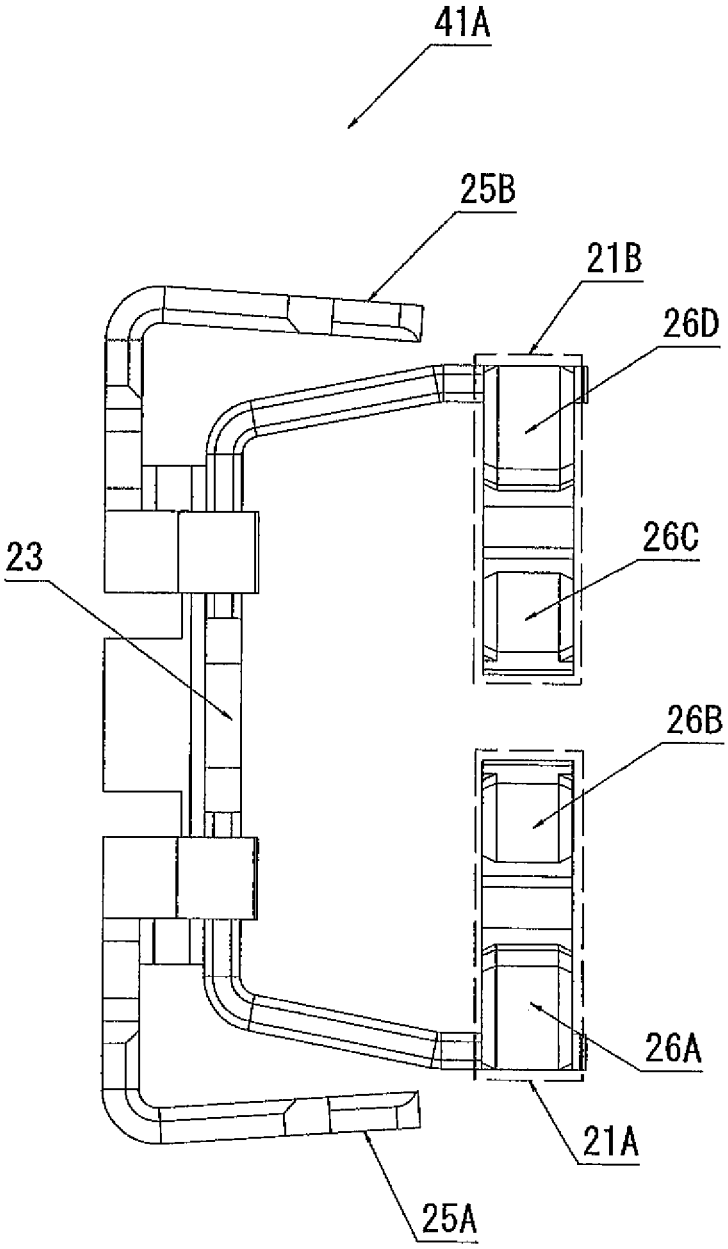
FIG. 5B is a plan view showing the receptacle-side power supply contact.
Figure 5C:
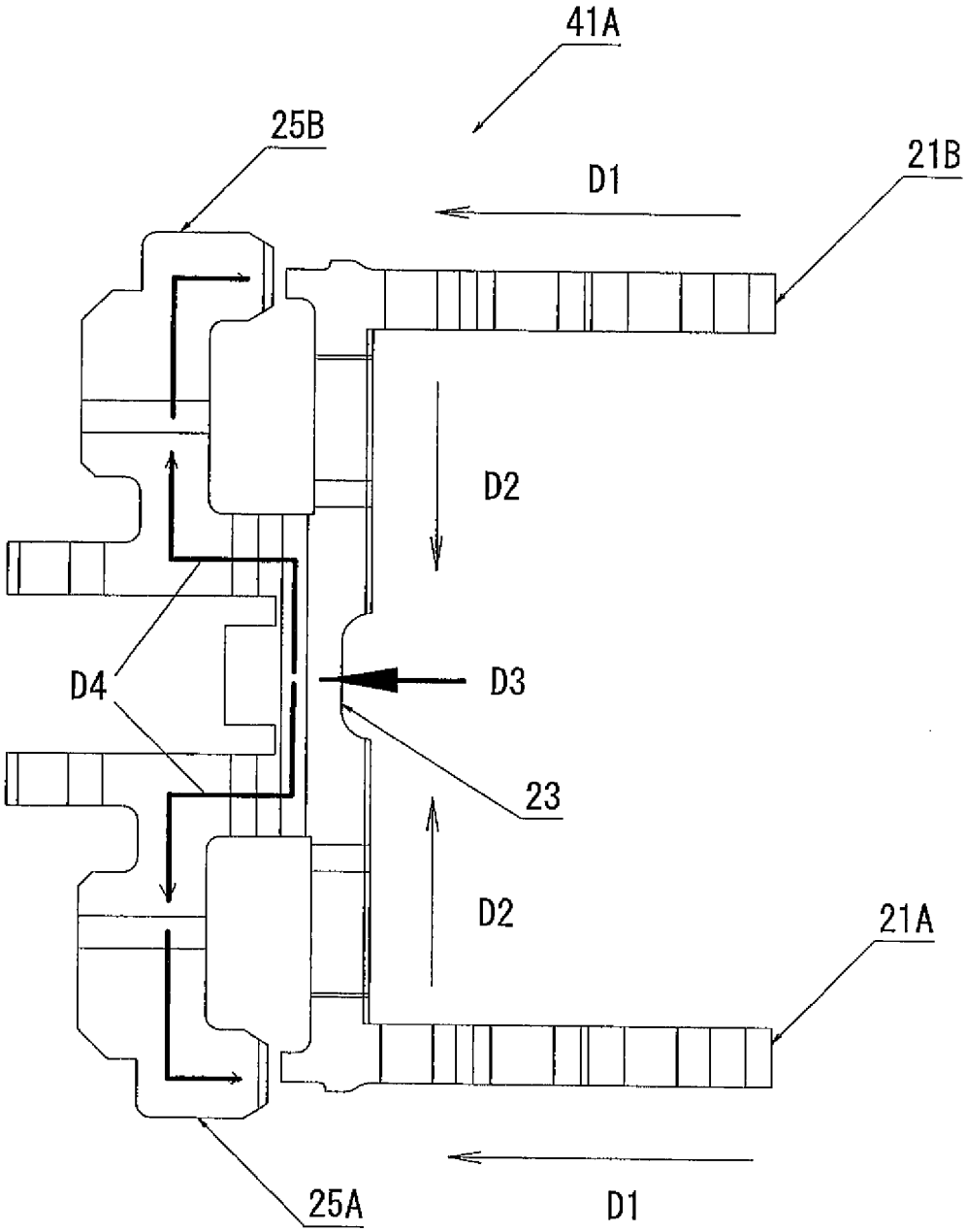
FIG. 5C is a developed view of the receptacle-side power supply contact.
Figure 5D:
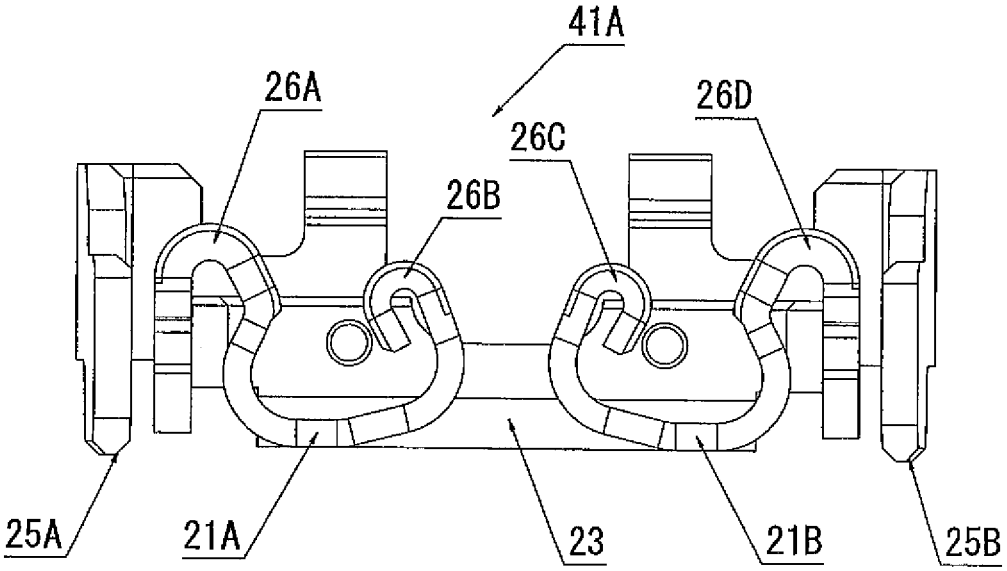
FIG. 5D is a front view showing the receptacle-side power supply contact.

The contact portions 21A and 21B are symmetrical in shape with each other as seen from the front (FIG. 5D).

Further, the contact portions 21A and 21B are integrally formed through a plate-like connecting portion 23. Herein, the connecting portion 23 is provided so as to connect, among end portions 26A, 26B, 26C, and 26D of the contact portions 21A and 21B, the end portions 26A and 26D being the outer end portions to each other.

Although details will be described later, by configuring the receptacle-side power supply contact 41A to have the pair of integrally formed spring contact portions 21A and 21B, it is possible, like the plug-side power supply contact 5A, to surely divide a current path into the contact portions 21A and 21B in electrical conduction and thus to prevent heat generation due to the electrical conduction.

In particular, by arranging the contact portions 21A and 21B to be symmetrical in shape, the power supply current can be surely divided when it flows.

Further, by forming each of the contact portions 21A and 21B as the U-shaped bent-plate spring, the spring length can be set long and thus, even if the plug connector 1 and the receptacle connector 3 are repeatedly attached and detached, it is possible to prevent the contact portions 21A and 21B from being deformed due to metal fatigue.

On the other hand, the receptacle-side power supply contact 41A has mounting portions 25A and 25B for connecting the receptacle connector 3 to a board or the like as a connection object. Herein, the mounting portions 25A and 25B are surface mount (SMT) terminals for connection to the board or the like by soldering.

As shown in FIG. 5B, the mounting portions 25A and 25B are provided so as to be offset with respect to the facing surfaces of the contact portions 21A and 21B.

More specifically, the mounting portions 25A and 25B are arranged so as to be offset in a direction (direction C2 in FIG. 5A) crossing a direction (direction C1 in FIG. 5A) in which the surfaces of the contact portions 21A and 21B face each other.

In this manner, by offsetting the arrangement of the mounting portions 25A and 25B, i.e. by arranging the mounting portions 25A and 25B in a position so as not to overlap the contact portions 21A and 21B in the plane, even if solder wicking occurs when the mounting portions 25A and 25B are soldered to the non-illustrated board or the like, the solder does not reach the contact portions 21A and 21B.

Consequently, it is possible to prevent an increase in contact resistance of the contact portions 21A and 21B due to adhesion of the solder thereto and to prevent heat generation due to such an increase in contact resistance.

Since the structure of the receptacle-side power supply contact 41B is the same as that of the receptacle-side power supply contact 41A, description thereof is omitted.

Next, processes of joining the plug connector 1 to the receptacle connector 3 in the connector unit 100 will be briefly described with reference to FIGS. 6A to 6C.

Figure 6A:
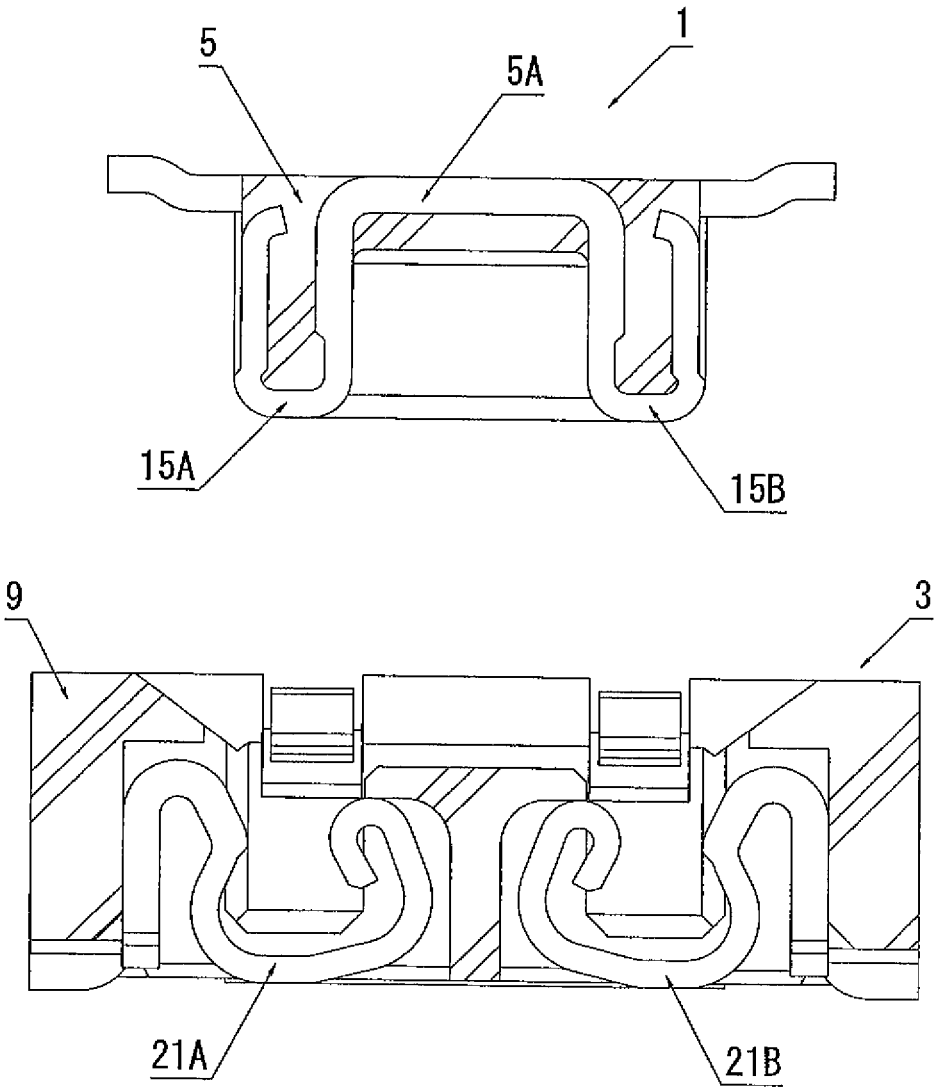
FIG. 6A is an A-A cross-sectional view of FIG. 1, wherein the plug-side power supply contact and the receptacle-side power supply contact are shown in a front view.

First, as shown in FIG. 6A, the positions of the contact portions 21A and 21B of the receptacle connector 3 in the plane and the positions of the contact portions 15A and 15B of the plug connector 1 in the plane are matched with each other and then the contact portions 15A and 15B are inserted into the contact portions 21A and 21B.

In this event, the outside of the U-shape of the contact portions 15A and 15B are brought into contact with the inside of the U-shape of the contact portions 21A and 21B of the receptacle connector 3, thereby pressing the contact portions 21A and 21B in a direction in which the U-shape thereof is opened.

Figure 6B:
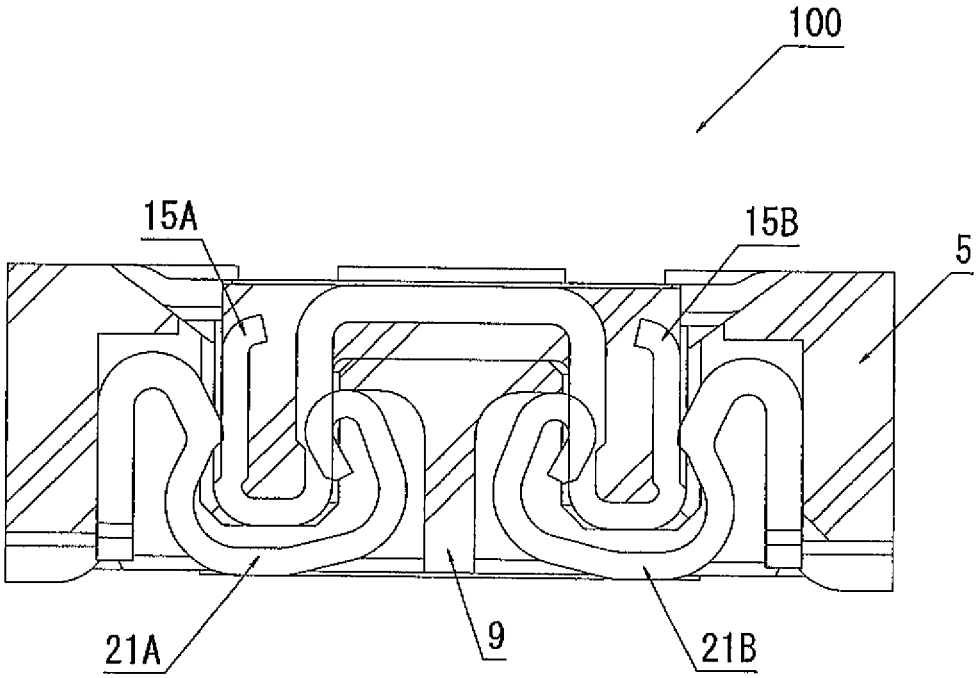
FIG. 6B is a cross-sectional view showing a state where the plug connector and the receptacle connector are joined together from the state of FIG. 6A, wherein the plug-side power supply contact and the receptacle-side power supply contact are shown in a front view.
Figure 6C:
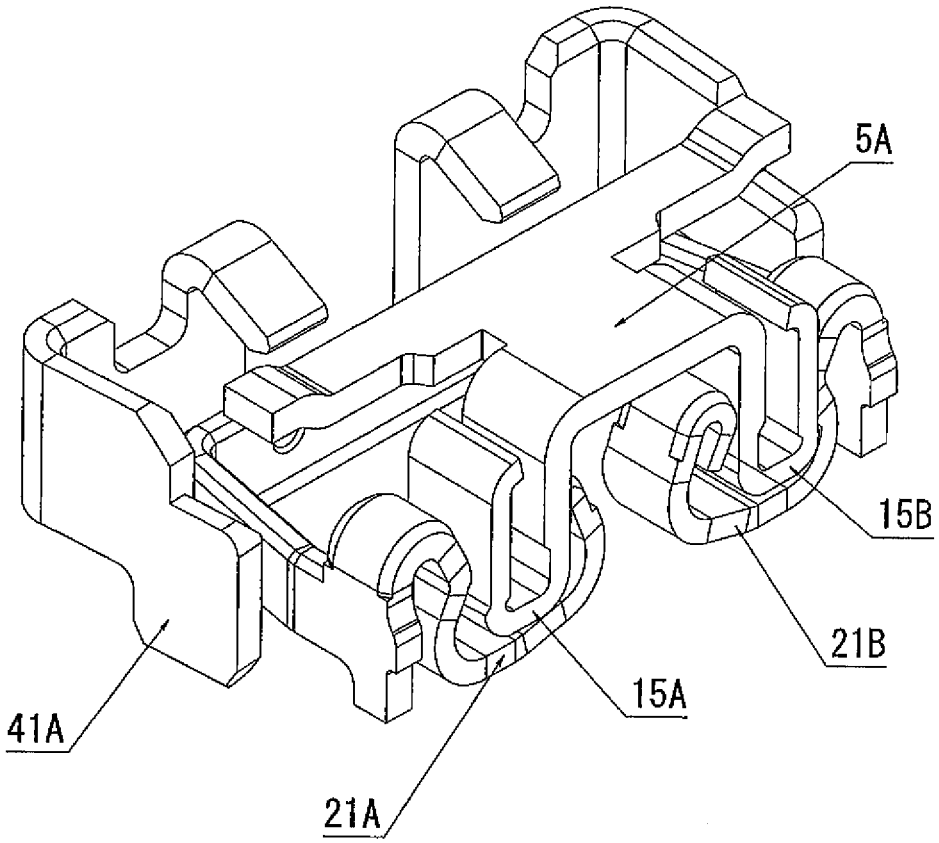
FIG. 6C is a perspective view showing only the plug-side power supply contact and the receptacle-side power supply contact in FIG. 6B.
Figure 7:
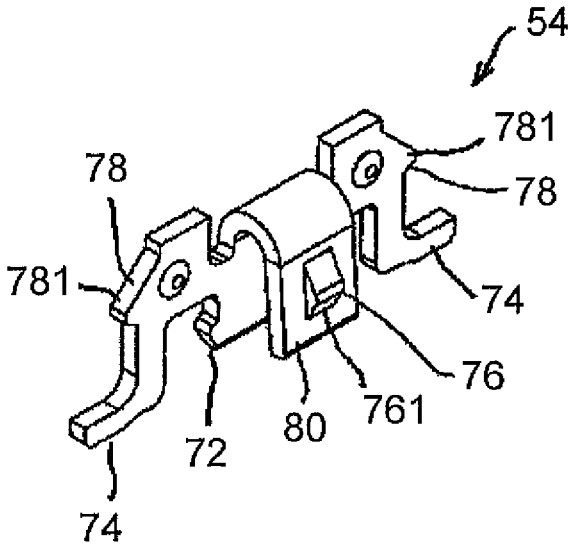
FIG. 7 is a perspective view showing one example of a prior art power supply contact.

Consequently, while being elastically deformed in the direction in which the U-shape is opened, the contact portions 21A and 21B engage with the contact portions 15A and 15B as shown in FIGS. 6B and 6C, thereby enabling electrical conduction.

In this state, if a power supply current is caused to flow between the plug-side power supply contact 5A and the receptacle-side power supply contact 41A, the power supply current is divided into the contact portions 15A and 15B through the connecting portion 17 from the mounting portions 19A and 19B and then the currents flow into the contact portions 21A and 21B, respectively, and are joined at the connecting portion 23 to reach the mounting portions 25A and 25B.

To give a more specific description of the current that flows in the receptacle-side power supply contact 41A, as shown in FIG. 5C, when the currents flow in a direction of arrow D1 from the contact portions 21A and 21B, the currents reaching the connecting portion 23 flow in directions D2 to be joined together (see arrow D3) and then the current is divided again to flow in directions of arrow D4 and reaches the mounting portions 25A and 25B.

Therefore, it is possible to surely divide the current path into the contact portions 15A and 15B and into the contact portions 21A and 21B in electrical conduction and thus to prevent heat generation due to the electrical conduction.

The plug-side power supply contact 5A and the receptacle-side power supply contact 41A are configured such that the contact portion 15A and the contact portion 21A engage with each other and the contact portion 21B and the contact portion 15B engage with each other.

In other words, the receptacle-side power supply contacts 41A and 41B are each configured to grasp the plug-side power supply contact 5A or 5B at two points.

Consequently, the contact reliability between the plug-side power supply contact 5A and the receptacle-side power supply contact 41A can be enhanced than conventional.

As described above, according to this embodiment, the plug connector 1 comprises the plug-side housing 5 and the plug-side power supply contact 5A which is held by the plug-side housing 5 and in which the power supply current flows, wherein the plug-side power supply contact 5A comprises the pair of integrally formed spring contact portions 15A and 15B each having the bent-plate shape and the pair of contact portions 15A and 15B are provided so that their flat surfaces face each other.

Therefore, the plug connector 1 can surely divide the power supply current and thus can prevent heat generation due to electrical conduction.

According to this embodiment, in the plug connector 1, the mounting portions 19A and 19B are provided so as to be offset with respect to the facing surfaces of the contact portions 15A and 15B.

Therefore, the plug connector 1 makes it possible to prevent an increase in contact resistance of the contact portions 15A and 15B due to adhesion of a solder thereto and to prevent heat generation due to such an increase in contact resistance.

Further, according to this embodiment, the receptacle connector 3 comprises the receptacle-side housing 9 and the receptacle-side power supply contact 41A which is held by the receptacle-side housing 9 and in which the power supply current flows, wherein the receptacle-side power supply contact 41A comprises the pair of integrally formed spring contact portions 21A and 21B each having the bent-plate shape and the pair of contact portions 21A and 21B are provided so that their flat surfaces face each other.

Therefore, the receptacle connector 3 can surely divide the power supply current and thus can prevent heat generation due to electrical conduction.

According to this embodiment, in the receptacle connector 3, the mounting portions 25A and 25B are provided so as to be offset with respect to the facing surfaces of the contact portions 21A and 21B.

Therefore, the receptacle connector 3 makes it possible to prevent an increase in contact resistance of the contact portions 21A and 21B due to adhesion of a solder thereto and to prevent heat generation due to such an increase in contact resistance.

While the preferred embodiment of this invention has been described with reference to the accompanying drawings, this invention is not limited thereto. It is apparent that those skilled in the art can think of various changes and modifications in the category described in claims and it is understood that those also naturally belong to the technical scope of this invention. For example, the description has been given of the case where the contact portions are provided in a pair in the above-mentioned embodiment, but as long as there is at least one pair of contact portions, two or more pairs may be provided.

What is claimed is:

1. An electrical connector comprising:

a housing; and a power supply contact which is held by the housing and in which a power supply current flows, wherein the power supply contact comprises at least a pair of integrally formed spring contact portions each having a bent-plate shape and having flat surfaces facing each other, the pair of integrally formed spring contact portions electrically contacting another pair of other contact portions of a power supply contact of another connector, respectively, a connecting portion which connects the pair of contact portions to each other, and a pair of mounting portions which are provided to the connecting portion so as to be offset with respect to the flat surfaces of the contact portions, wherein the pair of contact portions are provided so as to be symmetrical with respect to the connecting portion, wherein the pair of mounting portions are provided so as to be symmetrical with respect to the connecting portion, wherein the connector is a plug connector, and wherein the connecting portion has a plate-like shape and is provided to contact inner end portions of the contact portions to each other.

2. The electrical connector according to claim 1, wherein the connecting portion is provided with a mounting portion.

3. The electrical connector according to claim 1, comprising a plurality of signal contacts which are held by the housing and in which a signal current flows, wherein the power supply contact is provided at each of both ends in an arrangement direction of the signal contacts.

4. A connector unit comprising, in combination, the electrical connector according to claim 1 and a mating connector.

5. An electrical connector comprising:

a housing; and a power supply contact which is held by the housing and in which a power supply current flows, wherein the power supply contact comprises at least a pair of integrally formed contact portions each in the form of a plate-like member having a U-shape as seen in a surface direction and having flat surfaces facing each other, the pair of integrally formed spring contact portions electrically contacting a pair of other contact portions of a power supply contact of another contact of another connector, respectively, a connecting portion which connects the pair of contact portions to each other, and a pair of mounting portions which are provided to the connecting portion so as to be offset with respect to the flat surfaces of the contact portions, wherein the pair of contact portions are provided so as to be symmetrical with respect to the connecting portion, wherein the pair of mounting portions are provided so as to be symmetrical with respect to the connecting portion, wherein the electrical connector is a plug connector, and wherein the connecting portion is a plate-like member which is provided to connect, among end portions of the U-shape of the pair of contact portions, the inner end portions to each other.

6. The electrical connector according to claim 5, wherein the connecting portion is provided with a mounting portion.

7. The electrical connector according to claim 5, comprising a plurality of signal contacts which are held by the housing and in which a signal current flows, wherein the power supply contact is provided at each of both ends in an arrangement direction of the signal contacts.

* * * * *